United States Patent [19]

Nishino et al.

[11] Patent Number: 4,902,389

[45] Date of Patent: Feb. 20, 1990

[54] PROCESS FOR PRODUCING ALUMINUM SUPPORT FOR PRINTING PLATE

[75] Inventors: Atsuo Nishino; Tsutomu Kakei, both of Shizuoka, Japan

[73] Assignee: Fuji Photo Film Co., Ltd., Minami Ashigara, Japan

[21] Appl. No.: 272,330

[22] Filed: Nov. 17, 1988

[30] Foreign Application Priority Data

Nov. 27, 1987 [JP] Japan ..... 62-297835

[51] Int. Cl.[4] ..... C25F 3/04

[52] U.S. Cl. ..... 204/129.1; 204/129.35; 204/129.75; 204/129.95; 204/129.5

[58] Field of Search ..... 204/129.1, 129.35, 129.4, 204/129.6, 129.75, 129.95, 129.5, DIG. 9, 206

[56] References Cited

U.S. PATENT DOCUMENTS

| | | | |
|---|---|---|---|
| 3,884,783 | 5/1975 | Austin | 204/129.35 |
| 3,935,080 | 1/1976 | Gumbinner et al. | 204/129.75 |
| 4,214,961 | 7/1980 | Anthony | 204/129.1 X |
| 4,272,342 | 6/1981 | Oda et al. | 204/129.75 X |
| 4,326,933 | 4/1982 | Sabatka et al. | 204/206 X |
| 4,597,837 | 7/1986 | Oda et al. | 204/DIG. 9 |

FOREIGN PATENT DOCUMENTS 896563 5/1962 United Kingdom .

*Primary Examiner*—Donald R. Valentine

*Attorney, Agent, or Firm*—Burns, Doane, Swecker & Mathis

[57] ABSTRACT

A process for producing an aluminum support for a printing plate, which involves electrochemical graining of the support, is disclosed. The support is passed through an acidic electrolyte of an electrolytic cell along a path of travel maintained a distance above alternatingly distributed anodes and cathodes in a face-to-face relationship with the aluminum-containing support. Simultaneously, there is applied a d-c voltage between the alternating anodes and cathodes to produce an electrochemically roughened support.

The electrochemically roughened supports produced in accordance with the invention have a grained structure. characterized by a uniform and dense distribution of high depth-to-diameter ratio pits and exhibit satisfactory print quality and running characteristic without causing any uneveness.

7 Claims, 2 Drawing Sheets

PROCESS FOR PRODUCING ALUMINUM SUPPORT FOR PRINTING PLATE

BACKGROUND OF THE INVENTION

The present invention relates to a process for producing aluminum support for a printing plate. In particular, roughening of the aluminum support which is present in an acid and/or salt electrolyte is effected by an direct current.

Aluminum plates (including aluminum alloy plates) are extensively used as supports for printing plates and particularly as supports for offset printing plates. In order to be used as supports for offset printing plates, such aluminum plates must exhibit a suitable degree of adhesion to photo-sensitive layers as well as good water retention. To this end, the surface of an aluminum plate is roughened to have a uniform and finely grained surface. Since this roughening or graining treatment significantly affects the printing performance and running characteristics (press life) of the offset printing plate produced from the grained aluminum plate, the success of the roughening treatment is a key factor in the production of printing plates.

Aluminum supports for printing plates are currently roughened using the a-c electrolytic etching method, with the current being an ordinary sinusoidal current or a special alternating wave (e.g. square wave ) current. Using graphite or some other suitable material as a counter-electrode, roughening of the aluminum plate is usually achieved with a single application of a-c current. A drawback of such technique, however, is that the depth of roughened surface by this method are generally small and insufficient to ensure good running characteristics. Therefore, various approaches have been proposed for making aluminum plates that have a grain characterized by a uniform and dense distribution of high depth-to-diameter ratio roughness and thus, are suitable for use as supports for printing plates.

The proposals made so far are based on optimizing parameters such as the ratio of electricity to be applied respectively to the anode and the cathode during electrolytic roughening with a-c current (Japanese Unexamined Patent Application (OPI) No. 65607/1979); the waveform of the voltage which is supplied from a power source (Japanese Unexamined Patent Application (OPI) No. 25381/1980); and combinations of variable currents to be applied per unit area (Japanese Unexamined Patent Application (OPI) No. 29699/1981).

Despite such efforts, however, the depth of roughened surface produced by these prior art techniques are not sufficiently large and have such uneven depth profiles so as to provide a complexly undulating pattern. Not surprisingly, therefore, offset printing plates made by using aluminum supportshaving such defective pits are far from being satisfactory in terms of both printing performance and running characteristics.

With a view to solving this problem, it was proposed in U.S. Pat. No. 4,482,434 to perform electrochemical roughening with a-c current having low frequencies, i.e., in the range of 1.5–15 Hz. However, the use of low-frequency a-c current in electrochemical roughening of an aluminum plate as proposed in U.S. Pat. No. 4,482,434 has its own disadvantages. First, a printing plate formed from an aluminum support that has been subjected to continuous electrochemical roughening by this method gives rise to uneven printing results due to the formation . of lateral defects that run perpendicularly to the direction in which the aluminum plate traveled. Second, the use of low-frequency a-c current is not adapted to commercial operations since the carbon electrode used in conventional electrochemical roughening undergoes rapid dissolution.

In addition to the above disadvantages, the a-c electrochemical roughening methods of the prior art typically require special power supply units which translates into increased equipment costs.

SUMMARY AND OBJECTS OF THE INVENTION

In view of the foregoing limitations and shortcomings of prior art roughening techniques as well as other disadvantages not specifically mentioned above, it should be apparent that there still exists a need in the art for a roughened aluminum plate having a uniform and dense grained surface exhibiting a suitable degree of adhesion to light sensitive layers as well as good water retention. It is, therefore, a primary objective of the present invention to fulfill that need by providing a process for producing an aluminum support for making a printing plate such as an offset printing plate that gives rise to satisfactory printing performance and running characteristics without suffering from any unevenness in the printing due to the formation of lateral defects and which is in the form of an aluminum plate having a grain structure that is characterized by a uniform and dense distribution of pits having high depth-to-diameter ratios.

It is a further object of the present invention to provide a process for producing an aluminum support for making a printing plate which does not require special power supply units typically necessary for a-c roughening methods, thereby providing simplicity in harnessing busbars from the power supply unit to the electrolytic cell and reducing equipment costs.

Briefly described, these as well as other objects are achieved by providing a process for producing an aluminum-containing support for a printing plate which involves electrochemical graining of the support comprising:

(i) passing the support through an electrolytic cell along a path of travel maintained a distance alternatingly distributed anodes and cathodes in a face-to-face relationship with the aluminum-containing support; and (ii) simultaneously applying d-c voltage between said anodes and cathodes to produce an electrochemically roughened support.

With the foregoing as well as other objects, advantages, and features of the invention that will become hereinafter apparent, the nature of the invention may be more clearly understood by reference to the following detailed descriptions, the appended claims, and the attached drawings:

DETAILED DESCRIPTION OF PREFERRED EMBODIMENTS

The present invention is based on intensive studies in order to achieve the above-mentioned objects by providing a process for continuously and electrochemically roughening an aluminum plate in an acidic aqueous electrolyte solution such as a solution including nitric acid or hydrochloric acid. As a result, the present process was devised in which the aluminum support is allowed to travel a certain distance (1) maintained a distance above alternating anodes and cathodes in a face-to-face relationship with the aluminum support and (2) with a d-c voltage simultaneously being applied between the anode and cathode plates.

The aluminum plate electrochemically roughened by this method is suitable as a support for printing plates since it has a grained structure characterized by a uniform and dense distribution of pits having high depth-to-diameter ratios and since the plate does not give rise to any unevenness in printing, such as offset printing, as manifested by the formation of transverse streaks. According to this method, aluminum plates with a roughened surface suitable as supports for printing plates can be consistently produced in an industrially advantageous manner.

Therefore, the above-stated objects of the present invention are realized by virtue of a process for producing an aluminum support for a printing plate which involves continuous electrochemical roughening of an aluminum support in an acidic electrolyte, wherein the aluminum support passes along a path of travel maintained a distance above alternating anodes and cathodes in a face-to-face relationship with said aluminum support and wherein a d-c voltage is applied between the anode and cathode plates.

Figure 1:
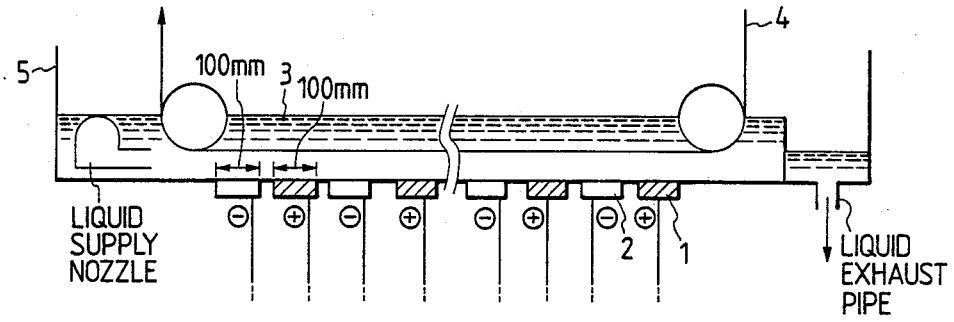
FIG. 1 is a diagrammatic view of an apparatus that may be employed to implement the process of the present invention.
Figure 3:
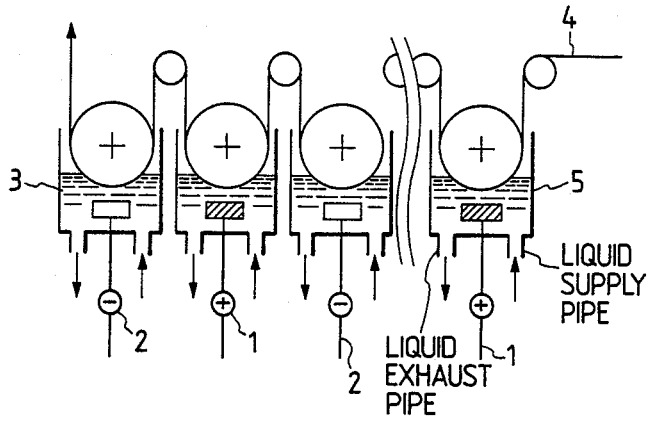
FIG. 3 is a diagrammatic view of another apparatus that may be employed to implement the process of the present invention.

Anodes 1 and cathodes 2 may be placed in one vessel in such a way that they alternate as shown in FIG. 1. An alternative electrode arrangement, shown in FIG. 3, is to place an anode and a cathode in separate vessels, with the vessel containing the anode alternating with the vessel containing the cathode.

The acidic electrolyte used in the present invention is preferably an acidic aqueous solution including nitric acid or hydrochloric acid. Other useful acidic electrolytes include a liquid mixture of nitric acid and hydrochloric acid as well as an aqueous solution containing nitric acid or hydrochloric acid in admixture with an organic acid, sulfuric acid, phosphoric acid, hydrofluoric acid or hydrobromic acid.

Examples of the aluminum support that can be treated by the present invention include pure aluminum plates and aluminum-based alloy plates.

Prior to carrying out the electrochemical roughening according to the present invention, the aluminum support may be subjected to preliminary treatments such as alkali etching (immersing the alumina plate in aqueous caustic soda to remove any surface dirt or spontaneous oxide film), followed by immersion of the plate in an aqueous solution of nitric acid or sulfuric acid to perform post-etching neutralization or desmutting. Another preliminary treatment that can be performed is to clean the surface of the aluminum support by electropolishing in an electrolyte including either sulfuric acid or phosphoric acids. These preliminary treatments are optional and may be selectively conducted according to a particular need.

The d-c current used in electrochemically roughening the aluminum plate according to the present invention has a waveform that does not change in polarity such as a comb-shaped d-c current, a continuous d-c current, or a commercial a-c current that has been subjected to full-wave rectification with a thyristor. It is particularly preferable to employ a smoothed continuous d-c current.

Any of the electrolytic baths that are commonly employed in a-c electrochemical roughening may be used in the present invention. A particularly advantageous electrolytic bath is an aqueous solution containing 5–20 g/L of hydrochloric acid or nitric acid. The bath temperature is preferably in the range of 20°–60° C. The current density is preferably in the range of 20–200 $A/dm^2$. The duration of the electrolysis treatment is preferably between 5 and 90 seconds. When the duration of the electrolysis is too long or too short an optimum roughened surface is not produced. Electrochemical roughening by the method of the present invention may be performed either batchwise, semicontinuously or continuously, the last-mentioned continuous system being the most preferred.

The electrochemically roughened aluminum support is then immersed in an acid- or alkali-containing aqueous solution so as to remove aluminum hydroxide-based smut formed during the electrochemical roughening and to perform light etching. This step is effective in ensuring the production of an even better aluminum support for the printing plate. Light etching may be accomplished by electropolishing in a phosphoric acid or sulfuric acid-based electrolyte.

Any of the electrodes that are commonly employed in known electrochemical treatments may be used in the present invention. Useful anode materials include valve metals, e.g., titanium, tantalum and niobium plated or clad with platinum-group metals; valve metals having applied or sintered coatings of oxides of platinum-group metals; aluminum; and stainless steel. Particularly useful anodic materials are valve metals clad with platinum. The anode life can be further extended by cooling the electrode with internally flowing water. Useful cathode materials are those metals which will not dissolve at a negative electrode potential. Such metals can be selected with reference to the Pourbaix diagram. A particularly preferred cathodic material is carbon.

Satisfactory results of roughening can be attained irrespective of the electrode arrangement. Thus, the electrode that is to be disposed at the delivery end of the electrolytic system may be either the anode or the cathode. If the anode is positioned at the delivery end, a uniform grained surface is produced with a comparatively small quantity of electricity. If a cathode is placed at the delivery end, fairly deep pits are produced with ease.

A suitable electrode arrangement may be selected in accordance with a specific grained surface to be produced.

A desired grained surface can be attained by adjusting such factors as the anode and cathode lengths in the direction in which the aluminum plate advances, the travel speed of the plate, the flow rate of the electrolyte, the temperature of the electrolyte, the bath composition, and the current density. If anodes and cathodes are placed in separate vessels as shown in FIG. 3, electrolytic conditions may be varied from vessel to vessel.

The aluminum plate roughened by the procedures described above is then anodized in a sulfuric acid or phosphoric acidcontaining electrolyte by standard procedures, so as to produce a support for the printing plate that not only has high degrees of hydrophilicity and water retention but also has good running characteristics. Needless to say, the anodizing treatment may be followed by immersion of the plate in an aqueous solution containing sodium silicate or other materials that are capable of rendering the plate surface hydrophilic.

While the particular procedures of electrochemical roughening of the present invention have been described above, it should be understood that they can be combined with known procedures of electrochemical roughening, such as a combined nitric acid/hydrochloric acid bath, a-c electrolysis for achieving electrochemical roughening, roughening interposed by a desmutting step, and electrochemical roughening divided in stages over a sequence of treatment baths.

EXAMPLES

The following examples are provided for the purpose of further illustrating the present invention but are in no way to be take as limiting.

EXAMPLE 1

Figure 2:
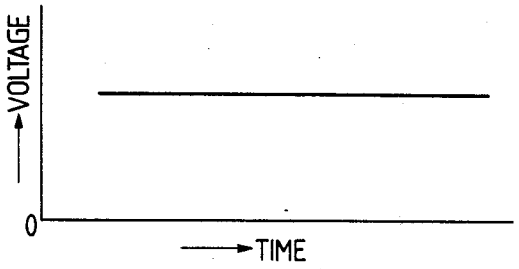
FIG. 2 depicts the voltage waveform of a d-c current that may be employed in the process of the present invention.

Referring to FIG. 1, an aluminum plate 4 (JIS 3003-H14) was cleaned by immersion in an aqueous solution of 10% caustic soda for 30 seconds and subsequently washed with water. The aluminum plate 4 was continuously passed through an electrolytic cell 5 containing twenty-eight alternating anodes (platinum) 1 and cathodes (carbon) 2 in an electrolyte 3, with the anode-to-cathode distance being 100 mm. The travel of the aluminum plate was so adjusted that it was held a distance of 10 mm above the electrodes 1 and 2. The electrodes were arranged in such a way that an anode was positioned at the delivery end of the electrolytic cell. The current density per electrode as 80 A/dm$^2$, with smoothed continuous d-c current (see FIG. 2) being applied. Both anode 1 and cathode 2 were 100 mm long in the direction in which the aluminum plate was advancing. The aluminum plate 4 travelled at a speed of 12 m/min. The electrolyte 3 was an aqueous solution containing 15 g of nitric acid per liter and its temperature was 45° C. After emerging from the electrolytic cell 5, the aluminum plate 4 was washed with water and immersed in an aqueous solution (60° C.) containing 300 g/L of sulfuric acid for 60 seconds so as to remove the aluminum hydroxide-based smut that had been formed during the electrochemical roughening treatment. The plate was then washed with water.

The roughened aluminum plate thus obtained had an average surface roughness of 0.21 μm and a uniform honeycomb structure of pits with an average diameter of 3 μm. This aluminum plate was anodized in an aqueous solution (35° C.) containing 100 g/L of sulfuric acid in such a way that an oxide film would be deposited on the plate surface in an amount of 2.0 g/m$^2$. After washing with water, the plate was immersed in an aqueous solution (70° C.) of 2.5% sodium silicate (JIS No. 3) for 20 seconds so as to render the plate surface hydrophilic.

A printing plate was made by coating a photo-sensitive layer on the so treated aluminum plate The printing plate was satisfactory in terms of print quality, running characteristics ($10^5$ runs) and resistance to soiling.

The aluminum plate prepared in Example 1 was entirely free from the unevenness in treatment that occurred in Comparative Example 1 (see below) perpendicularly to the advancing direction of the aluminum plate. The roughening treatment was conducted for twenty-four continuous hours but neither anode nor cathode dissolved.

EXAMPLE 2

An aluminum plate was roughened by repeating the procedures of Example 1 except that cleaning with caustic soda was not performed prior to the electrochemical etching. A printing plate produced using the so treated aluminum plate had the same appearance and grained structure as those attained in Example 1. Therefore, the uneven grain that might have occurred by omitting the preliminary treatment with caustic soda was absent.

COMPARATIVE EXAMPLE 1

An aluminum plate (JIS 3003H14) was cleaned by immersion in an aqueous solution of 10% caustic soda for 30 seconds. The cleaned plate was then washed with water.

Figure 4:
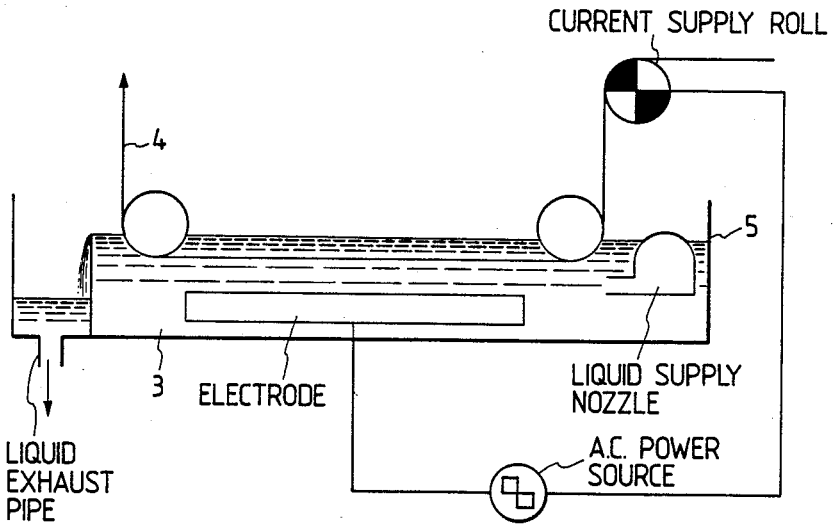
FIG. 4 is a diagrammatic view of an apparatus that is employed to implement the prior art process.

The aluminum plate was continuously roughened with an apparatus of the type shown in FIG. 4, with a-c current of rectangular wave-form (0.5 Hz) being applied at a current density of 80 A/dm$^2$. The treatment was continued for 14 seconds. The electrode was a carbon electrode and power was supplied via an aluminum roll. The aluminum plate was allowed to travel at a distance of 10 mm above the carbon electrode. The electrolyte used was an aqueous solution containing 15 g/L of nitric acid. The bath temperature was 45° C. After emerging from the electrolytic cell, the aluminum plate was washed with water and immersed in an aqueous solution (60° C.) containing 300 g/L of sulfuric acid for 60 seconds so as to remove the aluminum hydroxide-based smut that had been formed during the electrochemical roughening. The plate was subsequently washed with water.

The grained plate thus obtained had an average surface roughness of 0.21 μm and a honeycomb structure of pits with an average diameter of 3 μm.

This aluminum plate, however, was defective in its appearance and had a detectable degree of unevenness in treatment that occurred perpendicularly to the direction of travel of the plate. The periodicity of the occurrence of this defect correlated closely to the data that was obtained from the relationship between the travelling speed of the aluminum plate and the frequency presented by the power source used in the electrochemical roughening treatment. Examination under a scanning electron microscope revealed that the defective areas had a different grain structure than that observed in the other areas of the plate.

When the treatment was continued for 24 hours, the carbon electrode dissolved extensively and the electrolyte turned pitch dark.

The so prepared aluminum plate was anodized in an aqueous solution (35° C.) containing 100 g/L of sulfuric acid until an oxide film was deposited in an amount of 2.0 g/m$^2$. After washing with water, the plate surface was rendered hydrophilic by immersion in an aqueous solution (70° C.) of 2.5% sodium silicate (JIS No. 3) for 20 seconds.

A printing plate was fabricated by coating a photosensitive layer on the grained surface. The printing plate was capable of $10^5$ runs in the flawless areas but only $7\times10^4$ runs were achieved in the areas where unevenness in roughening treatment had occurred.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A process for producing an aluminum-containing support for a printing plate which involves electrochemical graining of the support comprising (i) passing said support through an acidic electrolyte in an electrolytic cell along a path of travel maintained a distance above alternatingly distributed anodes and cathodes in a face-to-face relationship with said aluminum-containing support and (ii) simultaneously applying d-c voltage between said anodes and cathodes to produce an electrochemically roughened support.

2. The process of claim 1 wherein said acidic electrolyte is an aqueous solution of at least one of hydrochloric acid and nitric acid.

3. The process of claim 2 wherein said acidic electrolyte further includes an organic acid, sulfuric acid, phosphoric acid, hydrofluoric acid or hydrobromic acid.

4. The process of claim 1 further comprising alkali etching and post-etching neutralization or desmutting of the support prior to the passing step (i).

5. The process of claim 1 further comprising electropolishing the support in an electrolyte prior to said passing step (i).

6. The process of claim 1 wherein said d-c current is comb-shaped, continuous, or commercial a-c current that has been subjected to full-wave rectification with a thyristor.

7. The process of claim 1 further comprising immersing the electrochemically roughened support in an acid or alkali-containing aqueous solution so as to remove aluminum hydroxide-based smut formed during the roughening and to perform light etching.

* * * * *